US012097400B2

(12) United States Patent
Casagrande

(10) Patent No.: US 12,097,400 B2
(45) Date of Patent: Sep. 24, 2024

(54) EXERCISER MONITORING SYSTEM AND METHOD OF OPERATION OF THE SYSTEM

(71) Applicant: TECHNOGYM S.P.A., Cesena (IT)

(72) Inventor: Simone Casagrande, Cesena (IT)

(73) Assignee: TECHNOGYM S.P.A., Cesena FC (IT)

( * ) Notice: Subject to any disclaimer, the term of this patent is extended or adjusted under 35 U.S.C. 154(b) by 177 days.

(21) Appl. No.: 17/659,810

(22) Filed: Apr. 19, 2022

(65) Prior Publication Data

US 2022/0331642 A1 Oct. 20, 2022

(30) Foreign Application Priority Data

Apr. 20, 2021 (IT) ..... 102021000009983

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 2220/40* (2013.01); *A63B 2225/20* (2013.01)

(58) Field of Classification Search
CPC ..... A63B 21/0726; A63B 21/00058–00069; A63B 21/06; A63B 21/072–075; A63B 24/0087; A63B 71/06; A63B 71/0036; A63B 2071/0683; A63B 2071/0655; A63B 2071/068; A63B 2220/40; A63B 2220/52; A63B 2225/20; A63B 2225/50; A63B 2244/09
See application file for complete search history.

(56) References Cited

U.S. PATENT DOCUMENTS 7,261,678 B2 * 8/2007 Crawford ..... A63B 71/0054 482/94
9,126,072 B2 * 9/2015 Watterson ..... A63B 21/0726
9,375,602 B2 * 6/2016 Krull ..... A63B 21/075
(Continued)

FOREIGN PATENT DOCUMENTS

CN 211 158 386 U 8/2020
EP 1 539 304 A2 6/2005
WO WO 03/103777 A2 12/2003

OTHER PUBLICATIONS

Italian Search Report issued for Italian Patent Application No. 202100009983, dated Jan. 11, 2022 in 7 pages.

*Primary Examiner* — Loan B Jimenez
*Assistant Examiner* — Kathleen M Fisk
(74) *Attorney, Agent, or Firm* — Knobbe, Martens, Olson & Bear, LLP

(57) ABSTRACT

A monitoring system is for the regulation of the weight of a dumbbell, employable by a user for the execution of a gymnastic exercise, having a supporting frame, a dumbbell, placed on the supporting frame, equipped with a handle, having an axial development along an axis, capable of rotating around the axis, clockwise and counterclockwise, and equipped with a first end and a second end, a first plurality of weights, placed on the supporting frame, in which each weight is individually coupable to the first end by a first selection member, when the handle rotates one way, and detachable from the first end, when the handle rotates the opposite way, a second plurality of weights, placed on the supporting frame.

13 Claims, 5 Drawing Sheets

(56) References Cited

U.S. PATENT DOCUMENTS

| | | | | |
|---|---|---|---|---|
| 9,776,032 | B2 * | 10/2017 | Moran | A63B 24/0087 |
| 9,814,922 | B2 * | 11/2017 | Moran | A63B 21/0726 |
| 9,895,571 | B2 * | 2/2018 | Wang | A63B 21/0724 |
| 10,195,477 | B2 * | 2/2019 | Marjama | A63B 21/0728 |
| 10,974,093 | B2 * | 4/2021 | Wang | A63B 24/0087 |
| 11,413,490 | B1 * | 8/2022 | Xu | A63B 21/0726 |
| 11,771,942 | B2 * | 10/2023 | Casagrande | A63B 24/0087 482/108 |
| 2016/0184623 | A1 | 6/2016 | Moran et al. | |
| 2018/0169459 | A1 * | 6/2018 | Wang | A63B 21/4035 |
| 2022/0331642 | A1 * | 10/2022 | Casagrande | A63B 21/075 |
| 2023/0080174 | A1 * | 3/2023 | Paganelli | A63B 21/4035 482/108 |

* cited by examiner

EXERCISER MONITORING SYSTEM AND METHOD OF OPERATION OF THE SYSTEM

CROSS-REFERENCE TO RELATED APPLICATIONS

This application claims priority to Italian Patent Application No. 102021000009983, filed on Apr. 20, 2021, the contents of which are incorporated herein by reference in its entirety.

TECHNICAL FIELD

The present invention relates to a system for monitoring an exercise machine, in particular for monitoring the weight adjustment of a dumbbell for performing a gymnastic exercise.

The present invention also relates to the method of operation of the weight adjustment monitoring system of a dumbbell.

More in detail, the invention relates to a system, designed and manufactured in particular to monitor the regulation of the weight loaded on a dumbbell for the execution of a strength gymnastic exercise, but which can be used for any gymnastic exercise that includes the use of a dumbbell. In the following, the description will be directed to a dumbbell comprising a system for monitoring the adjustment of the weight selected from a plurality of weights that can be selected based on the strength gymnastic exercise to be performed, but it is clear that the same should not be considered limited to this specific use.

BACKGROUND

As is well known, strength training systems are currently employed to develop strength and improve a user's muscular endurance.

Activities typically associated with strength training involve the use of resistance, often in the form of weights, to cause a user's muscles to contract, increasing muscle strength and the function of tendons, ligaments, and joints, such as for example exercises for the biceps, for the back, for the triceps and the like.

Workouts may therefore require the use of free weights, such as barbells and dumbbells, in which a user controls the movement or the position of these weights over a period of time or for a number of sets and reps.

When performing exercises with free weights, a user may undertake movements unconstrained by support equipment and thus a user often performs such movements in an environment without equipment, such as in a home environment.

Usually, both dumbbells and barbells include a rod or handle at the ends of which one or more weights, usually having a circular shape, are fixed according to the resistance necessary for the execution of the exercise.

Often the insertion of the weights on the rod turns out to be an operation that requires the user to stop exercising for a prolonged period necessary to load or unload the weights.

Therefore, compact weight loading systems have become widespread, mainly used for dumbbells, in which, by means of an actuation device, it is possible to select the weight from a plurality of weights already arranged near the rod, thus reducing loading and downloading times by the user.

In these types of dumbbells, it is necessary for the user to know the weight loaded on the dumbbell, to barbells perform the workout.

Weight detection devices are currently known which measure the weight loaded on the dumbbell during weight selection.

SUMMARY

However, such devices above often prove to be unreliable in measuring the exact weight.

In the light of the above, it is, therefore, an object of the present invention to provide a system for monitoring the weight adjustment of a dumbbell, which is reliable and easy to manufacture.

Another object of the invention is to provide a system, which allows the acquisition and the storage of the weight measurement carried out.

A further object is to provide a reliable method of operation of the detection system.

It is therefore specific object of the present invention a monitoring system for the regulation of the weight of a dumbbell, employable by a user for the execution of a gymnastic exercise, comprising: a supporting frame; a dumbbell, placed on said supporting frame, equipped with a handle, having an axial development along an axis, capable of rotating around said axis, clockwise and counterclockwise, and equipped with a first end and a second end, a first plurality of weights, placed on said supporting frame, in which each weight is individually coupable to said first end by a first selection member, when said handle rotates one way, and detachable from said first end, when said handle rotates the opposite way, a second plurality of weights, placed on said supporting frame, in which each weight is individually coupable to said second end by a second selection member, when said handle rotates one way, and detachable from said second end, when said handle rotates the opposite way, said system comprises at least one detection device capable of detecting at least one physical phenomenon caused by the rotation of said handle to couple or detach one or more weights of said first and second plurality of weights to and from said handle.

Further according to the invention, said detection device comprises a generating unit of said physical phenomenon associated with the rotation of said handle, and a detection unit, capable of detecting the physical phenomenon generated by said generating unit.

Still according to the invention, said generating unit is placed in said first selection member or in said second selection member or in both said first and second selection members.

Preferably according to the invention, said detection unit is placed coupled to said first selection member or to said second selection member or to said supporting frame.

Always according to the invention, said generating unit comprises an abutment member and at least one contact assembly capable of cooperating with said abutment member, for the generation of said physical phenomenon.

Further according to the invention, said abutment member is a plate, equipped on its surface with a plurality of markings, and said at least one contact assembly comprises a first generating member and a second generating member, placed in said first selection member or in said second selection member, in contact with said plate, in such a way to generate said physical phenomenon at the passage on said plurality of markings.

Still according to the invention, said first generating member comprises a first spring, placed in said first selection member or in said second selection member, a first pusher, placed in contact with said first spring, and a first sphere, capable of being in contact with said plate under the pressure of said first pusher and first spring, and said second generating member comprises a second spring, placed in said first selection member or in said second selection member, a second pusher, placed in contact with said second spring, and a second sphere, capable of being in contact with said plate under the pressure of said second pusher and second spring.

Preferably according to the invention, said detection unit comprises at least one sensor, capable of detecting the physical phenomenon generated by said generating unit, converting it into an electrical signal, and sending said electrical signal.

Always according to the invention, said system comprises a logic control unit, capable of receiving said electrical signal sent by said at least one sensor, processing it to associate the value of a weight of said first and second plurality of weights to said electrical signal, and sending said processed signal.

Further according to the invention, said system comprises a communication module, capable of receiving said electrical signal and/or said processed signal and sending them to remote devices or cloud units.

Still according to the invention, said sensor is capable of detecting a sound wave.

Preferably according to the invention, said sensor is a microphone.

Always according to the invention, said sensor is capable of detecting a mechanical vibration.

Further according to the invention, said sensor is an accelerometer.

Sill according to the invention, said detection unit comprises a gyroscope.

It is a further object of the present invention an operating method of a system for the monitoring of the regulation of the weight of a dumbbell, of the type comprising a supporting frame, a dumbbell, coupable to said supporting frame, comprising a handle capable of rotating around an axis, clockwise and counterclockwise, a first plurality of weights and a second plurality of weights, coupable to and detachable from said dumbbell, comprising the following steps:

(a) rotating the handle one way to select one or more weights of said first and second plurality of weights, or the opposite way to release one or more weights form said dumbbell, (b) generating a physical phenomenon associated to the rotation of said handle, (c) detecting said physical phenomenon generated in step (b);

(d) transducing said physical phenomenon detected in said step (c) into an electrical signal;

(e) processing said electrical signal obtained in said step (d) to associate a value of one or more weights selected or released in said step (a);

(f) sending said electrical signal obtained in said step (d) to remote devices and/or cloud units.

Further according to the invention, in said step (c) a sound wave is detected.

Still according to the invention, in said step (c) a mechanical vibration is detected.

BRIEF DESCRIPTION OF THE DRAWINGS

The present invention will be now described, for illustrative but not limitative purposes, according to its preferred embodiments, with particular reference to the figures of the enclosed drawings, wherein.

In the various figures the similar parts will be indicated with the same numerical references.

DETAILED DESCRIPTION

Figure 1:
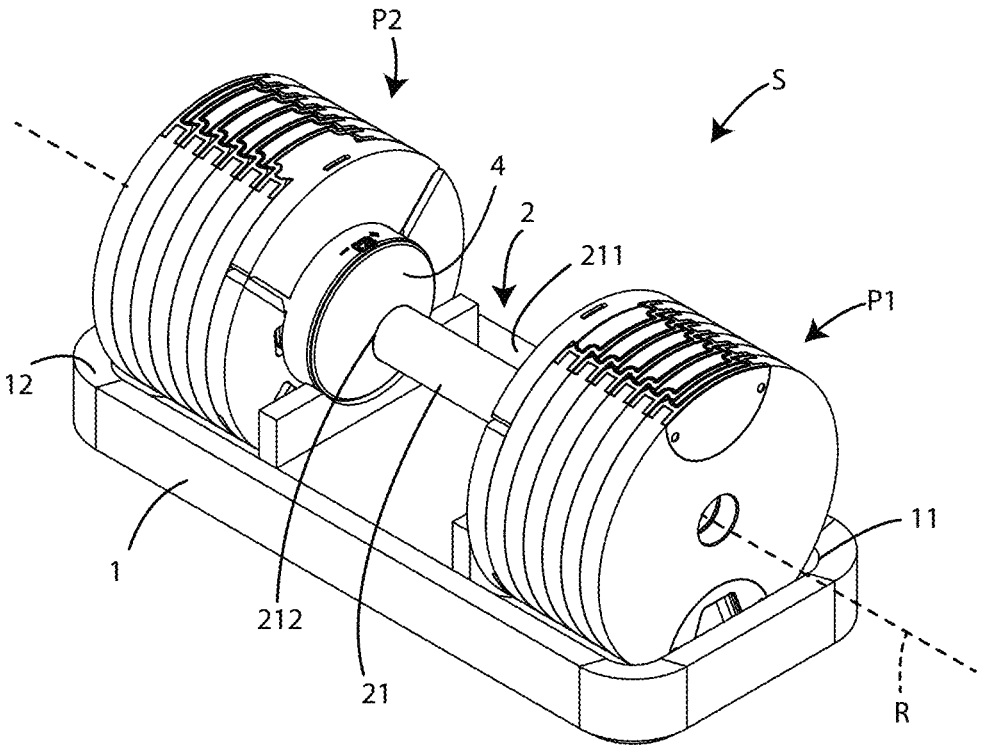
FIG. 1 shows a perspective view of the monitoring system for the adjustment of the weight of a dumbbell, object of the present invention.

With reference to FIG. 1, the system S for monitoring the weight adjustment of a dumbbell, object of the present invention, essentially comprises a support frame 1, a dumbbell 2, housed on said support frame 1, a first plurality of weights P1 and a second plurality of weights P2, which can be coupled to said dumbbell 2.

Said support frame 1 comprises a first housing 11 and a second housing 12.

Said dumbbell 2 comprises a handle 21, which extends axially along an axis R, around which said handle 21 is capable of rotating clockwise and counterclockwise.

Said handle 21 is an elongated hollow cylindrical body, which extends along said R axis.

Figure 2:
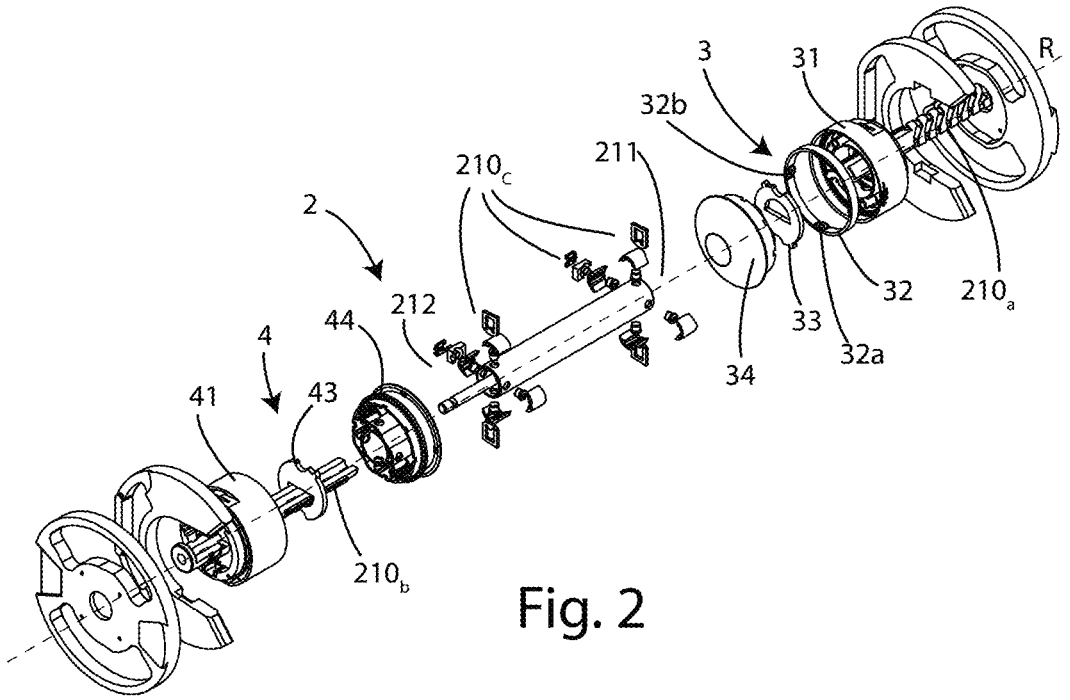
FIG. 2 shows an exploded view of the system shown in FIG. 1.

With reference to FIG. 2, a first selector element 210*a* and a second selector element 210*b* are housed inside it, on whose surfaces helical grooves are formed.

The rotation of the handle 21 causes a progressive translation along with the axis R of said first 210*a* and second 210*b* selector element. This allows selecting at least one weight both from said first P1 and from said second P2 plurality of weights.

Said first 210*a* and second 210*b* selector elements are movably coupled to said first handle 21 by means of a plurality of pins 210*c*, integral with said first handle 21.

Said first 210*a* and second 210*b* selector elements are capable of passing from a closed position, in which they are entirely contained inside said first handle 21 and face each other, towards a plurality of opening positions, in which they move away from each other by translating along said axis R, moving in opposite directions of said axis R.

The rotation of the handle 21, and of the plurality of pins 210*c* integral with it, causes the progressive axial displacement of said first 210*a* and second 210*b* selector element.

The plurality of pins 210*c* engages with the helical grooves of said first 210*a* and second 210*b* selector elements, causing their axial movement along the R axis.

Said handle 21 has a first end 211 and a second end 212.

At the first end 211, said first plurality of weights P1 is associated, while said second plurality of weights P2 is associated with the second end 212.

Each weight of said first P1 and second P2 plurality of weights is shaped, so as to ensure a shape coupling with the contiguous weights.

When said dumbbell 2 rests on said support frame 1, said first plurality of weights P1 is arranged in said first housing 11, while said second plurality of weights P2 is arranged in said second housing 12.

On each of said first 211 and second 212 ends selection members are arranged to fix each weight to said handle 21.

In particular, on said first end 211 a first selection member 3 is fixed, while on said second end 212 a second selection member 4 is fixed.

For ease of description, the description regarding the structure of said first selection member 3 is given below, since said second selection member 4 has an unchanged structure with respect to said first selection member 3.

Figure 3:
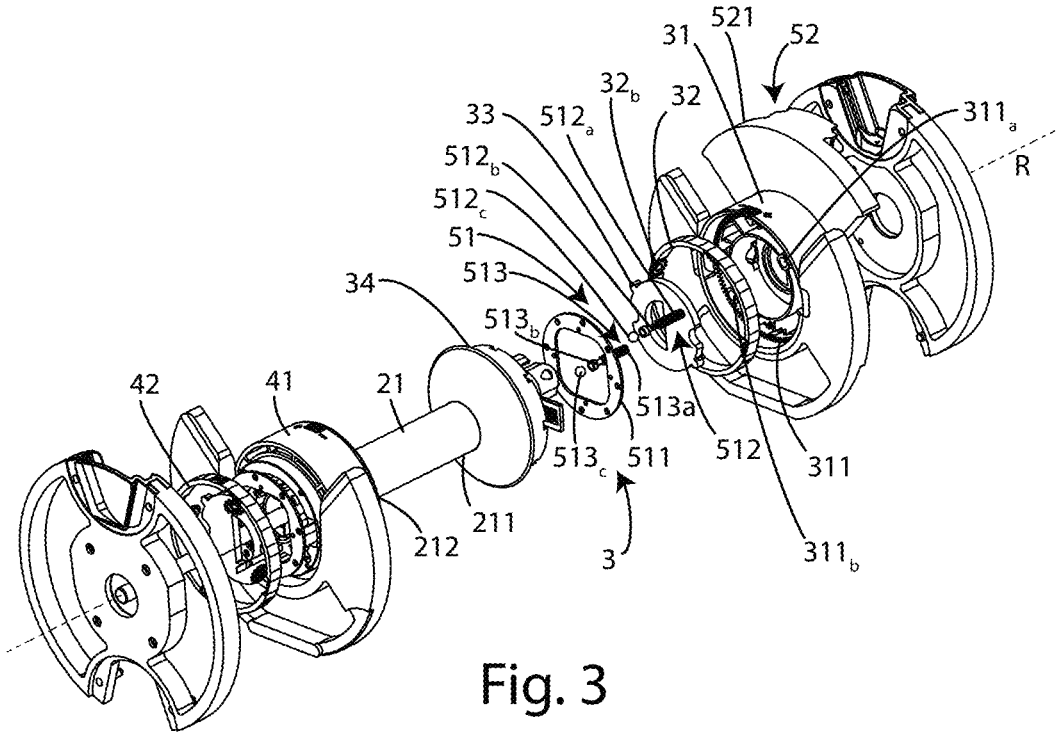
FIG. 3 shows a further exploded view of the system shown in FIG. 1.

Referring to FIGS. 2 and 3, said first selection member 3 comprises a hollow element 31, a numbered ring 32, a through coupling means 33, and a lid 34 for closing said first locking means 3.

Said hollow element 31, when resting on said support frame 1, is integral with it and therefore it is stationary.

Said hollow element 31 comprises inside a support 311 provided with a first cavity 311*a* and a second cavity 311*b*.

Said hollow element 31 also comprises inside a first circular toothed portion 312.

Said through coupling means 33 is a guide for the sliding of said first selector element 210*a*.

Said lid 34 is integral with said handle 21 and is therefore capable of rotating with it.

Said lid 34 comprises inside a second circular toothed portion 341.

Figure 5:
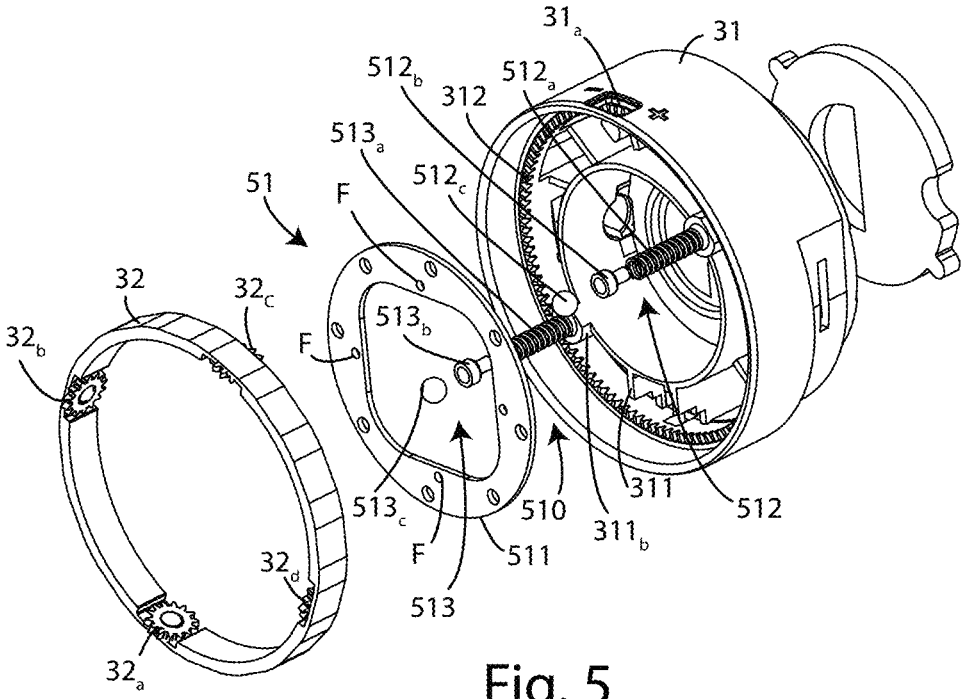
FIG. 5 shows an exploded view of some components of the system shown in FIG. 3.

As shown in FIG. 5, said numbered ring 32 comprises one or more wheels 32*n*, in particular, four wheels 32*a*, 32*b*, 32*c*, 32*d*, capable of engaging with said first 312 and second 341 circular toothed portion, so as to rotate together with said handle 21.

Said numbered ring 32 has numbers on its surface corresponding to the value of the weights selected from said first plurality of weights P1.

Said hollow element 31 has on its surface a window 31*a*, which allows viewing the numbers of the numbered ring 32 during the rotation, corresponding to the weight selected by said first plurality of weights P1.

Figure 4:
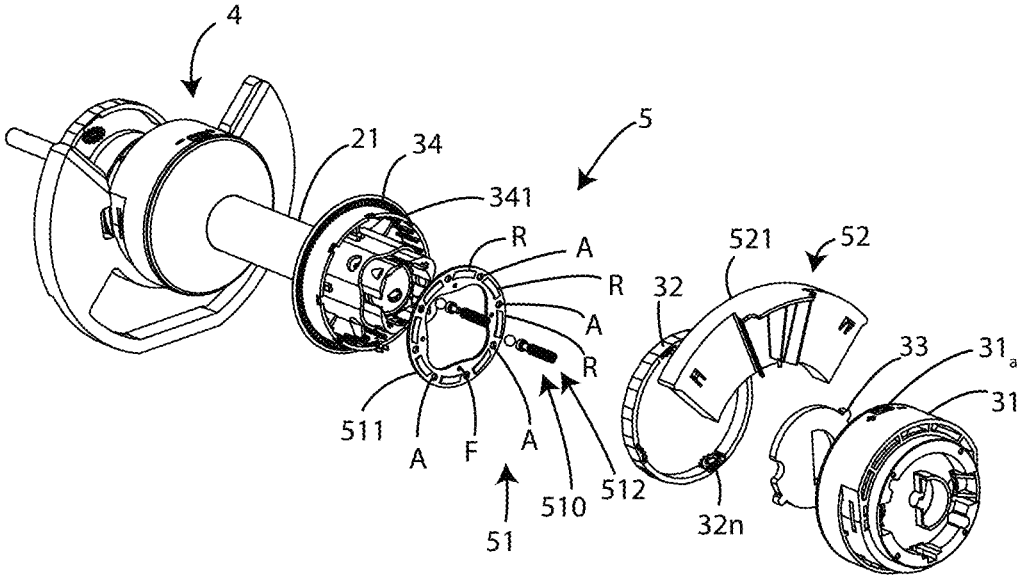
FIG. 4 shows a further exploded view of the system shown in FIG. 1.
Figure 9:
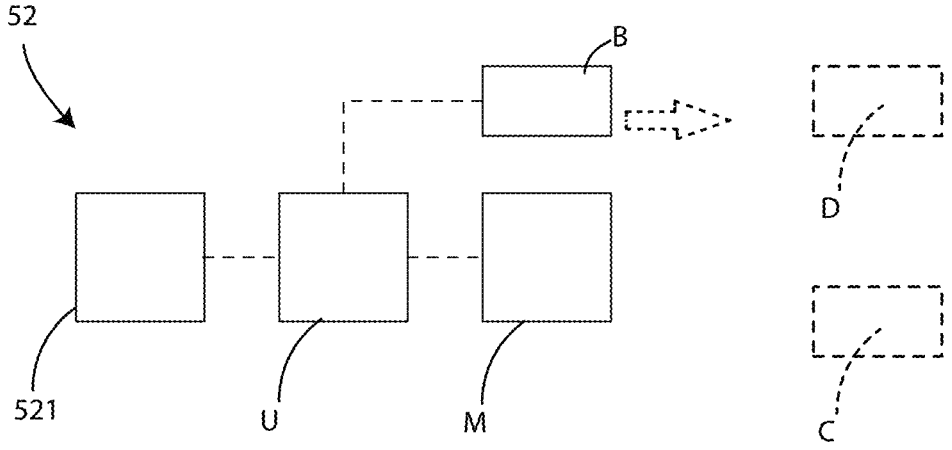
FIG. 9 shows a block schematic view of a component shown in FIG. 4.
Figure 10:
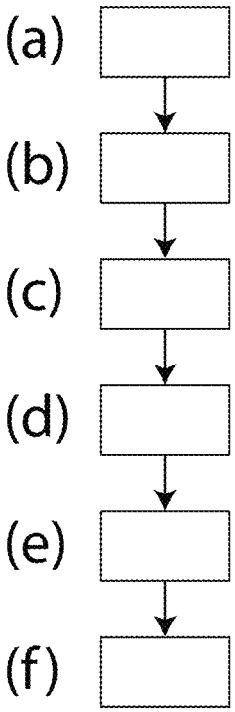
FIG. 10 shows a block diagram of the operation method of the system of FIG. 1.

With reference to FIGS. 4, 5, and 9, said monitoring system S comprises a device 5 for detecting the selected weight.

In particular, said detection device 5 comprises a unit 51 for generating a physical phenomenon, which causes a change in the state of the system S, and a unit 52 for detecting said physical phenomenon.

Said generation unit 51 is arranged in said first selection member 3.

Without departing from the scope of protection of the present invention, said generation unit 51 can also be arranged in said second selection member 4, or in both said first 3 and second 4 selection body.

Said generating unit 51 comprises an abutment member 511 and at least one contact assembly 510, capable of cooperating with said abutment member 511 for the generation of the physical phenomenon.

In particular, said abutment member is a plate 511 provided on its surface with a plurality of markings A, T, R.

Said at least one contact assembly 510 comprises a first 512 and a second generator 513.

Said markings A, T, R, can have different conformations: openings or through holes and/or depressions or grooves and/or ramps or reliefs.

The arrangement of said markings A, T, R on said plate 511 can have multiple configurations.

Figure 6:
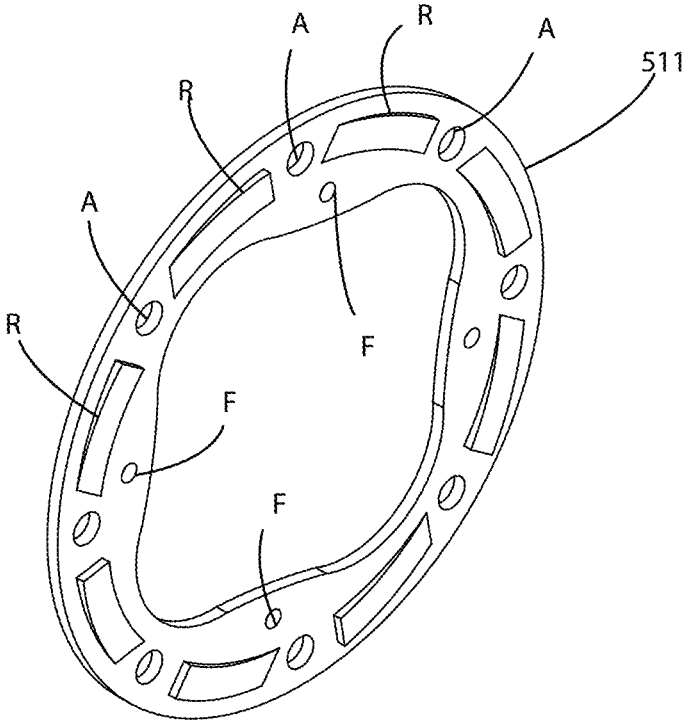
FIG. 6 shows a side perspective view of a first embodiment of the component shown in FIG. 4.

With reference to FIG. 6, in a first embodiment of said plate 511, it is possible that this has ramps R alternating with holes A.

Furthermore, there are also holes F for coupling the plate 511 with the lid 34.

Figure 7:
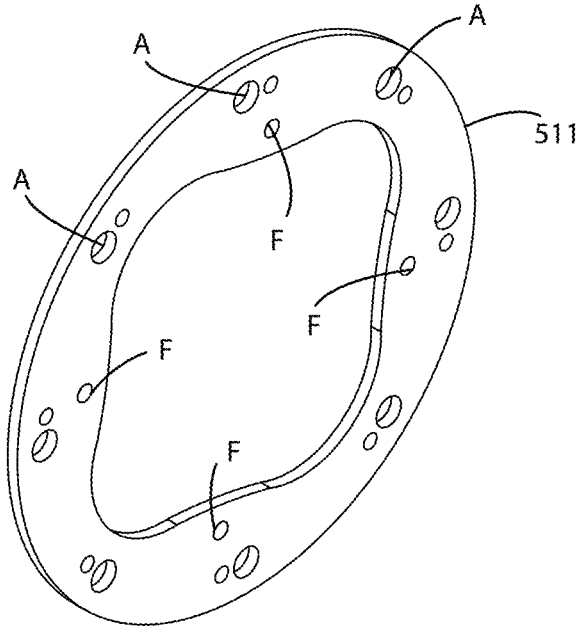
FIG. 7 shows a side perspective view of a second embodiment of the component shown in FIG. 4.

With reference to FIG. 7, in a second embodiment of said plate 511, it is possible that this plate has groupings of holes A with different diameters.

Figure 8:
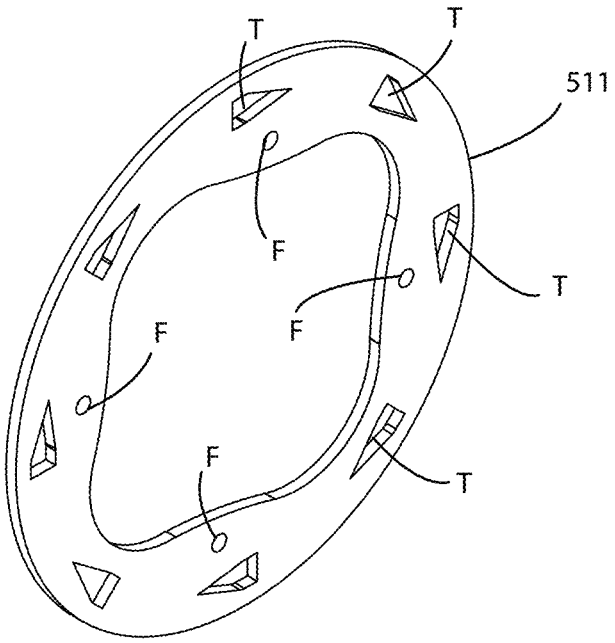
FIG. 8 shows a side perspective view of a third embodiment of the component shown in FIG. 4.

With reference to FIG. 8, in a third embodiment of said perforated plate 511, it is possible that this one has trapezoidal openings T.

In all embodiments of said plate 511, said holes A and said trapezoidal openings T can be depressions made on the plate 511.

Said first generator member 512 comprises a first spring 512*a*, a first pusher 512*b*, and a first sphere 512*c*.

Similarly, said second generating member 513 comprises a second spring 513*a*, a second presser 513*b*, and a second sphere 513*c*.

Said first 512 and second 513 generating members are coupled respectively to said first 311*a* and second 311*b* cavities of said support 311.

Said first 512*c* and second 513*c* sphere are arranged in contact respectively between said first 512*b* and second 513*b* pusher and said plate 511, in so as to be compressed respectively by said first 512*a* and second spring 513*a* on said plate 511.

When said plate 511 rotates, following the rotation of said handle 21, said markings A, T, R meet said first 512*c* and second 513*c* sphere, which engage with said markings A, T, R.

Said first 512*c* and second 513*c* spheres are capable of engaging in one or more of said markings A, T, R based on the weight selected by the rotation of said handle 21.

When said first 512*c* and second 513*c* sphere meet said markings A, T, R of said plate 511 a physical phenomenon occurs, which causes a detectable and measurable change of state.

By meeting between said first 512*c* and second 513*c* sphere with said markings A, T, R it is meant either the passage of said first 512*c* and second 513*c* sphere over said markings A, T, R, or the engagement between said first 512*c* and second sphere 513*c* with said markings A, T, R.

In fact, mechanical vibrations and/or sound waves are associated with this physical phenomenon, having a detectable frequency and wavelength, which vary over time and can be measured with appropriate sensors.

The rotation of said plate 511 in one direction causes the generation of physical phenomena different from those generated by the rotation in the opposite direction.

Furthermore, the passage of said first 512*c* and second 513*c* sphere on each markings A, T, R, opening or relief, present on the surface of said plate 511, causes the generation of different physical phenomena.

Said detection unit 52 can be arranged on said first selection member 3, by means of shape coupling.

Alternatively, said detection unit 52 can be arranged on said second selection member 4, by means of shape coupling.

Alternatively, said detection unit 52 can be arranged on said support frame 1.

With reference to FIG. 9, said detection unit 52 comprises at least one sensor 521, a memory unit M, a logic control unit U, and a wireless type data communication module B, for example, Bluetooth® or wi-fi or NFC or Ant+.

Said data communication module B is able to send said signal received by said control logic unit U to remote devices D, such as a smartphone, or to cloud C.

Said at least one sensor 521 is able to detect the physical phenomenon caused by the interaction between said contact assembly 510 and said abutment member 511.

In particular, said sensor 521 is able to detect the physical phenomenon caused by the engagement of said first 512*c* and second 513*c* sphere with said markings A, T, R.

In one embodiment, said detection unit 52 detects the sound or the noise generated by said first 512*c* and second 513*c* sphere during the rotation of said plate 511, in particular during the passage on said markings A, T, R, and converts the sound or noise detected in an electrical signal.

In this embodiment, the sensor 521 is a microphone or an array of microphones, such as a MEMs, condenser, piezoelectric or fiber optic or laser microphone.

In particular, said sensor 521 receives the sound wave and detects its amplitude as the difference between the pressure of the carrier and the maximum pressure caused by the wave.

The acquired sound wave has a frequency and intensity or volume, and also has a waveform that characterizes the perceived timbre and that allows to distinguish between different waves.

The signal thus generated by the sensor 521 is sent to the control logic unit U that processes it.

If the same markings A, T, R of said plate 511 and therefore the same wave is associated with each weight of the plurality of weights P1, then the logic control unit U increments a counter and stores the last value.

If different signs of said plate 511 and therefore different waves are associated with each weight of the plurality of weights P1, then the logic control unit U recognizes the different sounds and stores the last value.

In a further embodiment, in combination with or as an alternative to the previous one, the sensor 521 detects the mechanical vibration that is generated in the plate 511 following the passage and engagement of said first 512*c* and second 513*c* sphere with said markings A, T, R, and converts it into an electrical signal, which can be processed by said logic control unit U and stored in said memory unit M.

In this embodiment, the sensor 521 is a strain gauge or piezoresistive or piezoelectric or MEMs or LVDT accelerometer—Linear Variable Differential Transformer accelerometer.

In one embodiment, the control logic unit U acquires the signal processes it by determining the value of the selected weight and sends it to remote devices D, such as smartphones or tables and/or cloud C.

Alternatively, the logic unit control unit U sends the detected data to said remote devices D or C, for the data processing and weight determination.

With reference to all the embodiments described above, said detection unit 52 can comprise a gyroscope, capable of detecting the rotation direction of the handle 21.

The operation of the system S for monitoring the adjustment of the weight of a dumbbell object of the present invention takes place in the following way.

When a user intends to perform a strength exercise using the dumbbell 2, it is necessary to initially adjust the weight of said dumbbell 2, before lifting it from the support frame 1.

The user can rotate the handle 21 in one direction, for example clockwise, to select one or more weights from said first P1 and second P2 plurality of weights, so as to increase the weight on the dumbbell 2, or it can rotate the handle 21 in the opposite direction, for example counterclockwise, to uncouple one or more weights from the dumbbell 2, so as to decrease the weight on the dumbbell 2.

With each rotation of the handle 21, said first 210*a* and second 210*b* selector elements extend to select, or retract to release a weight of said first P1 and second P2 plurality of weights.

In particular, said first selector element 210*a* is progressively inserted into the holes of each weight of said first plurality of weights P1, while said second selector element 210*b* is progressively inserted into the holes of each weight of said second plurality of weights P2.

The weights are coupled to each other by means of shape coupling, so that, by lifting the dumbbell 2 from said support frame 1, the weights selected by said first 210*a* and second 210*b* selector element remain integral with the dumbbell 2, while the unselected weights remain housed on said support frame 1.

In the meantime, both for said first selection member 3 and for said second selection member 4, the rotation of the handle 21, and therefore of the lid 34, causes the rotation of said numbered ring 32, therefore it will be possible to see the weight selected through said window 31*a*.

Furthermore, the rotation of the handle 21 and therefore of the lid 34 causes the rotation of said plate 511.

Consequently, said markings A, T, R meet said first 512*c* and second 513*c* sphere and the passage and engagement with the markings A, T, R themselves cause the generation of the physical phenomenon.

The passage and engagement of said first 512*c* and second 513*c* sphere with the markings A, T, R corresponds to the selection or release of a weight of said first P1 and second P2 plurality of weights.

Said detection unit 52, in particular said sensor 521, detects the state change of the system S associated with the physical phenomenon, converts it into an electrical signal and sends it to said logic control unit U, which processes it to associate with each signal the value of a weight.

Said logic control unit U sends the electrical signal to said memory unit M to store it.

Said logic control unit U also sends the electrical signal to said communication module B, which also transmits the electrical signal to remote devices D and/or cloud C.

As is evident from the above description, the monitoring system object of the present invention allows the detection, in a simple and reliable way, of a weight loaded or released from the dumbbell for the execution of a gymnastic exercise.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A monitoring system for regulation of weight of a dumbbell, employable by a user for execution of a gymnastic exercise, comprising:

a supporting frame;

a dumbbell, placed on said supporting frame, equipped with a handle, having an axial development along an axis, capable of rotating around said axis, clockwise and counterclockwise, and equipped with a first end and a second end, a first plurality of weights, placed on said supporting frame, in which each weight is individually couplable to said first end by a first selection member, when said handle rotates one way, and detachable from said first end, when said handle rotates the opposite way, and a second plurality of weights, placed on said supporting frame, in which each weight is individually couplable to said second end by a second selection member, when said handle rotates one way, and detachable from said second end, when said handle rotates the opposite way, at least one detection device capable of detecting at least one physical phenomenon caused by the rotation of said handle to couple or detach one or more weights of said first and second plurality of weights to and from said handle, wherein said at least one detection device comprises:

a generating unit of said at least one physical phenomenon associated to the rotation of said handle, and a detection unit capable of detecting the at least one physical phenomenon generated by said generating unit, wherein said detection unit comprises at least one sensor, capable of detecting the at least one physical phenomenon generated by said generating unit, converting the at least one physical phenomenon into an electrical signal and sending said electrical signal, and said at least one sensor is capable of detecting a sound wave.

2. The monitoring system according to claim 1, wherein said generating unit comprises an abutment member and at least one contact assembly capable of cooperating with said abutment member, for the generation of said at least one physical phenomenon.

3. The monitoring system according to claim 2, wherein said abutment member is a plate having on its surface a plurality of markings, and said at least one contact assembly comprises a first generating member and a second generating member, placed in said first selection member or in said second selection member, in contact with said plate, to generate said at least one physical phenomenon at passage on said plurality of markings.

4. The monitoring system according to claim 3, wherein said first generating member comprises a first spring, placed in said first selection member or in said second selection member, a first pusher, placed in contact with said first spring, and a first sphere, capable of being in contact with said plate under pressure of said first pusher and first spring, and said second generating member comprises a second spring, placed in said first selection member or in said second selection member, a second pusher, placed in contact with said second spring, and a second sphere, capable of being in contact with said plate under the pressure of said second pusher and second spring.

5. The monitoring system according to claim 1, wherein said generating unit is placed in said first selection member or in said second selection member-or in both said first and second selection members.

6. The monitoring system according to claim 1, wherein said detection unit is placed coupled to said first selection member or to said second selection member or to said supporting frame.

7. The monitoring system according to claim 1, further comprising a logic control unit, capable of receiving said electrical signal sent by said at least one sensor, processing said electrical signal to associate value of a weight of said first and second plurality of weights to said electrical signal, and sending a processed signal.

8. The monitoring system according to claim 1, further comprising a communication module, capable of receiving said electrical signal and/or a processed signal and sending said electrical signal and/or said processed signal to remote devices or cloud units.

9. The monitoring system according to claim 1, wherein said at least one sensor is a microphone.

10. The monitoring system according to claim 1, wherein said detection unit further comprises a gyroscope.

11. A monitoring system for regulation of weight of a dumbbell, employable by a user for execution of a gymnastic exercise, comprising:

a supporting frame;

a dumbbell, placed on said supporting frame, equipped with a handle, having an axial development along an axis, capable of rotating around said axis, clockwise and counterclockwise, and equipped with a first end and a second end, a first plurality of weights, placed on said supporting frame, in which each weight is individually couplable to said first end by a first selection member, when said handle rotates one way, and detachable from said first end, when said handle rotates the opposite way, and a second plurality of weights, placed on said supporting frame, in which each weight is individually couplable to said second end by a second selection member, when said handle rotates one way, and detachable from said second end, when said handle rotates the opposite way;

at least one detection device capable of detecting at least one physical phenomenon caused by the rotation of said handle to couple or detach one or more weights of said first and second plurality of weights to and from said handle, wherein said at least one detection device comprises:

a generating unit of said at least one physical phenomenon associated to the rotation of said handle, a detection unit capable of detecting the at least one physical phenomenon generated by said generating unit, and said detection unit comprises at least one sensor capable of detecting the at least one physical phenomenon generated by said generating unit, converting the at least one physical phenomenon into an electrical signal and sending said electrical signal, wherein said at least one sensor is capable of detecting a mechanical vibration.

12. The monitoring system according to claim 11, wherein said at least one sensor is an accelerometer.

13. A method for monitoring of regulation of weight of a dumbbell, the system comprising a supporting frame, a dumbbell, couplable to said supporting frame, comprising a handle capable of rotating around an axis, clockwise and counterclockwise, a first plurality of weights and a second plurality of weights, couplable to and detachable from said dumbbell, comprising following steps:

(a) rotating the handle one way to select one or more weights of said first and second plurality of weights, or the opposite way to release one or more weights form said dumbbell, (b) generating a physical phenomenon associated to the rotation of said handle, (c) detecting said physical phenomenon generated in step (b);

(d) transducing said physical phenomenon detected in step (c) into an electrical signal;

(e) processing said electrical signal obtained in step (d) to associate a value of one or more weights selected or released in step (a) and (f) sending said electrical signal obtained in step (e) to remote devices and/or cloud units, wherein a sound wave is detected in said step (c).

* * * * *